US009859626B1

(12) United States Patent
Annis et al.

(10) Patent No.: US 9,859,626 B1
(45) Date of Patent: Jan. 2, 2018

(54) WIRE RETENTION SEAL FOR A TERMINAL ASSEMBLY

(71) Applicant: TE CONNECTIVITY CORPORATION, Berwyn, PA (US)

(72) Inventors: Kyle Gary Annis, Hummelstown, PA (US); Kevin Michael Thackston, York, PA (US); Albert Tsang, Harrisburg, PA (US); James Scott Showers, Stewartstown, PA (US); George E. Kell, Etters, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/434,626

(22) Filed: Feb. 16, 2017

(51) Int. Cl.
*H01R 9/05* (2006.01)
*H01R 4/18* (2006.01)

(52) U.S. Cl.
CPC ..... *H01R 4/183* (2013.01)

(58) Field of Classification Search
CPC H01R 13/52; H01R 13/5202; H01R 13/5205; H01R 13/5221
USPC ..... 439/587, 589, 877, 879, 274, 275, 730
See application file for complete search history.

(56) References Cited

U.S. PATENT DOCUMENTS

2004/0171304 A1* 9/2004 Tabata ..... H01R 4/185 439/587
2012/0171207 A1* 7/2012 Wilcox ..... A61K 38/1774 424/134.1
2013/0344723 A1* 12/2013 Peters ..... H01R 4/203 439/275

* cited by examiner

*Primary Examiner* — Phuong Dinh

(57) ABSTRACT

A terminal assembly includes a terminal having a wire barrel configured to be crimped to a wire and a mating segment configured to be mated to a mating component. The terminal assembly includes a wire retention seal received in the wire barrel. The wire retention seal has a terminal mounting flange engaging the wire barrel to axially secure the wire retention seal to the terminal. The wire retention seal has a wire retention sleeve defining a wire bore configured to receive an end of the wire. The wire retention sleeve is configured to interfere with the wire to axially retain the wire retention seal on the end of the wire prior to crimping the wire barrel to the wire.

20 Claims, 3 Drawing Sheets

WIRE RETENTION SEAL FOR A TERMINAL ASSEMBLY

BACKGROUND OF THE DISCLOSURE

Embodiments of the present disclosure generally relate to wire retention seals for terminal assemblies.

Terminal assemblies are used to provide power and/or data signals between various components. Some known terminal assemblies require environmental sealing between the wire and the terminal. Such terminal assemblies provide a seal in the terminal that is compressed with the wire barrel of the terminal during the crimping operation to corm the seal around the wire. The seal typically conforms to the terminal and has little or no interface with the wire prior to being crimped around the wire. A problem with such known terminal assemblies is that the terminal and seal tends to shift or move relative to the wire during handling and loading of the terminal into the crimping machine, leading to the possibility of the terminal and wire being improperly positioned during the crimping process and leading to a poor electrical connection and/or a poorly sealed connection.

Other known terminal assemblies utilize an O-ring positioned in a seal cavity in the terminal that provides sealing between the wire and the terminal. However, the O-rings provide inconsistent seal performance and in some cases complete failure when the O-ring is misplaced out of the seal cavity during wire insertion.

Accordingly, a need exists for a simpler and more efficient wire seal for crimped terminal assemblies.

BRIEF DESCRIPTION OF THE DISCLOSURE

In one embodiment, a terminal assembly is provided including a terminal having a wire barrel configured to be crimped to a wire and a mating segment configured to be mated to a mating component. The terminal assembly includes a wire retention seal received in the wire barrel. The wire retention seal has a terminal mounting flange engaging the wire barrel to axially secure the wire retention seal to the terminal. The wire retention seal has a wire retention sleeve defining a wire bore configured to receive an end of the wire. The wire retention sleeve is configured to interfere with the wire to axially retain the wire retention seal on the end of the wire prior to crimping the wire barrel to the wire.

In another embodiment, a terminal assembly is provided including a terminal having a wire barrel configured to be crimped to a wire and a mating segment configured to be mated to a mating component. The terminal assembly includes a wire retention seal received in the wire barrel. The wire retention seal has a terminal mounting flange engaging the wire barrel to axially secure the wire retention seal to the terminal. The wire retention seal has a wire retention sleeve defining a wire bore configured to receive an end of the wire. The wire retention sleeve has an inner surface defining the wire bore and facing the wire and an outer surface facing the wire barrel. The inner surface has inner sealing rings configured to seal against the wire and the outer surface has outer sealing rings configured to seal against the wire barrel. The wire retention sleeve is configured to interfere with the wire to axially retain the wire retention seal on the end of the wire prior to crimping the wire barrel to the wire.

In a further embodiment, a terminal assembly is provided including a terminal having a wire barrel configured to be crimped to a wire and a mating segment configured to be mated to a mating component. The wire barrel has a conductor barrel and a jacket barrel rearward of the conductor barrel. The conductor barrel is configured to be crimped to a conductor of the wire. The jacket barrel is configured to be crimped to a jacket of the wire. The terminal assembly includes a wire retention seal received in the jacket barrel. The wire retention seal has a terminal mounting flange engaging the wire barrel to axially secure the wire retention seal to the terminal. The wire retention seal has a wire retention sleeve defining a wire bore configured to receive an end of the wire. The wire retention seal is axially aligned with the jacket barrel and is radially spaced apart from the wire barrel prior to the wire barrel being crimped defining a relief space between the wire retention seal and the jacket barrel. The wire retention sleeve is configured to receive the end of the wire. The relief space provides a space for the wire retention sleeve to expand when the wire is loaded through the wire bore. The wire retention sleeve is configured to axially retain the wire retention seal on the end of the wire prior to crimping the wire barrel to the wire.

DETAILED DESCRIPTION OF THE DISCLOSURE

Figure 1:
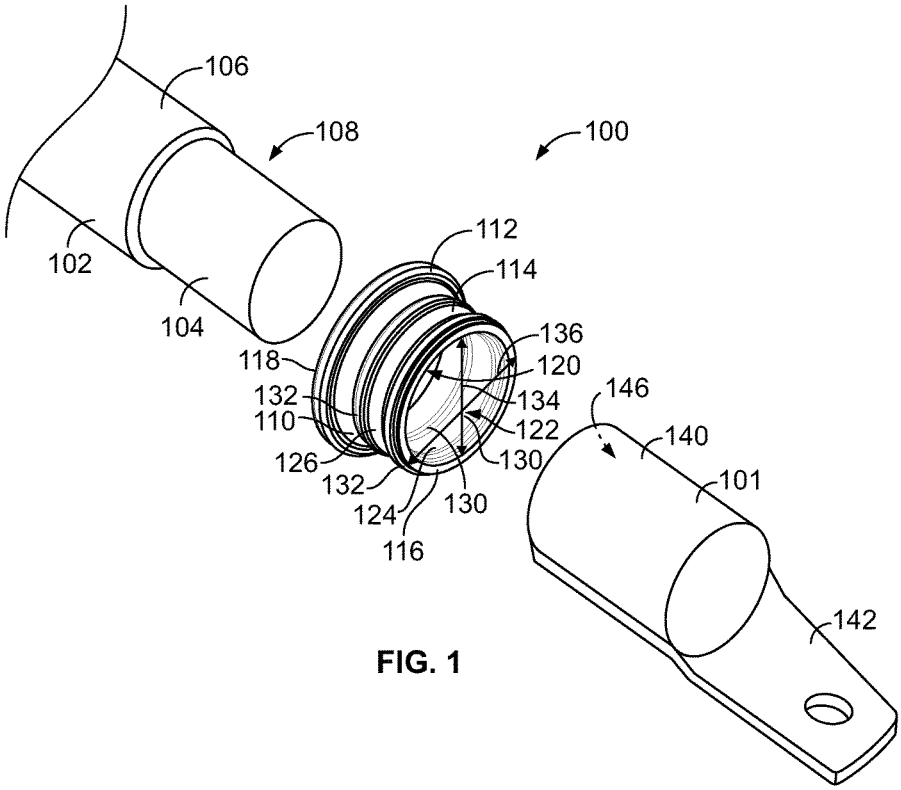
FIG. 1 is an exploded view of a terminal assembly in accordance with an exemplary embodiment.

FIG. 1 is an exploded view of a terminal assembly 100 in accordance with an exemplary embodiment. The terminal assembly 100 includes a terminal 101, a wire 102 configured to be terminated to the terminal 101, and a wire retention seal 110 used to retain the terminal 101 on the wire 102 during assembly and to provide environmental sealing for the wire 102 and the terminal 101. The wire 102 includes an internal conductor 104 that is covered by an insulating cover or jacket 106. The conductor 104 may be formed of a conductive metal, such as copper, aluminum, or the like. In an exemplary embodiment, the conductor 104 is a stranded wire. The insulating jacket 106 is formed of an insulating material, such as rubber, plastic, or the like. The wire 102 may include other layers such as a wire braid, an insulator layer, and the like. A portion of the insulating jacket 106 is stripped in order to expose an end 108 of the conductor 104. In an exemplary embodiment, the terminal 101 is configured to be crimped to the end 108 of the wire 102 with the wire retention seal 110 positioned between the wire 102 and the terminal 101.

The wire retention seal 110 is formed from a sealing material, such as rubber, silicone rubber, or the like. The wire retention seal 110 includes a terminal mounting flange 112 used to secure the wire retention seal 110 to the terminal 101 during assembly. For example, the terminal mounting flange 112 may be loaded into the terminal 101 prior to loading the wire 102 into the terminal 101. The terminal mounting flange 112 holds the axial position of the wire retention seal 110 in the terminal 101 for loading the wire 102 into the wire retention seal 110 and the terminal 101 during assembly.

The wire retention seal 110 includes a wire retention sleeve 114 extending from the terminal mounting flange 112. The wire retention sleeve 114 receives the end 108 of the wire 102 and is used to retain the wire 102 in the terminal 101 prior to crimping and/or to retain the terminal 101 on the wire 102 prior to crimping. The wire retention sleeve 114 may be sealed against the wire 102. The wire retention sleeve 114 may be sealed against the terminal 101 when the terminal 101 is crimped around the wire 102. The wire retention sleeve 114 is configured to be positioned between the wire 102 and the terminal 101 and is crimped against the wire 102 when the terminal 101 is crimped to the wire 102. The wire retention sleeve 114 is configured to be sealed to the insulating jacket 106. Optionally, the wire retention sleeve 114 is integral with the terminal mounting flange 112. For example, the wire retention sleeve 114 and the terminal mounting flange 112 may be co-molded or co-extruded from the same material.

The wire retention seal 110 extends between a front end 116 and a rear end 118. The wire retention sleeve 114 is provided at or near the front end 116. The terminal mounting flanges 112 is provided at or near the rear end 118. The front end 116 is configured to be loaded into the terminal 101. The wire 102 is rear loaded into the wire retention seal 110 through the rear end 118. The terminal mounting flange 112 is ring shaped and includes an opening 120 that receives the wire 102 during assembly. The wire retention sleeve 114 defines a wire bore 122 that receives the end 108 of the wire 102 as the wire 102 is loaded through the opening 120. The wire bore 122 defines an internal passage through the wire retention seal 110.

The wire retention sleeve 114 has an inner surface 124 defining the wire bore 122 and configured to face the wire 102. The wire retention sleeve 114 has an outer surface 126 configured to face the terminal 101 when received therein. The inner surface 124 has inner sealing rings 130 configured to seal against the wire 102. The outer surface 126 has outer sealing rings 132 configured to seal against the terminal 101. The inner sealing rings 130 narrow an inner diameter 134 of the wire bore 122 to seal against the wire 102. The outer sealing rings 132 increase an outer diameter 136 of the wire retention sleeve 114 to seal against the terminal 101. The wire retention sleeve 114 may be provided without any inner sealing rings 130 and/or without any outer sealing rings 132.

The insulating jacket 106 of the wire 102 is stripped to expose the end 108 of the conductor 104 such that the exposed end 108 is sized and shaped to be inserted into the wire bore 122 of the wire retention sleeve 114. During assembly, after the wire retention seal 110 is positioned in the terminal 101, the wire 102 is axially aligned with the wire retention seal 110 and urged into the wire bore 122 until the exposed end 108 of the conductor 104 is loaded through the wire retention seal 110 into the terminal 101. The wire retention seal 110 is flexible allowing the wire 102 to be inserted without damaging the wire 102. For example, the wire retention seal 110 does not damage or bend the individual wire strands as the wire 102 is loaded through the wire retention seal 110. When loaded, the end of the insulating jacket 106 is received in the wire bore 122. The wire 102 is configured to be held in the wire bore 122 of the wire retention sleeve 114 by an interference fit to axially secure the terminal 101 and the wire retention seal 110 on the wire 102. When the wire retention sleeve 114 engages the wire 102, the wire retention sleeve 114 does not slide along the wire 102, but rather holds tight to the wire 102 to avoid having the terminal fall off the end of the wire 102. As such, the wire 102 and the terminal 101 may be manipulated together as a unit. For example, the wire 102 and the terminal 101 may be transported to a crimping machine or other processing machine without needing to separately hold the wire 102 and the terminal 101. There is less risk of the terminal 101 and the wire 102 shifting relative to each other during the crimping process. Alternatively, instead of positioning the wire retention seal 110 in the terminal 101, the wire retention seal 110 may first be positioned on the wire 102 and then loaded into the terminal 101.

The terminal 101 may be any type of terminal. In an exemplary embodiment, the terminal 101 is a crimp terminal configured to be crimped to the wire 102. The terminal 101 includes a wire barrel 140 connected to a base 142 at a mating segment 144 of the terminal. The base 142 may be a flat strap, panel, tab, pin, socket, or the like, which is configured to be electrically and mechanically connected to a component, device, or the like. For example, the base 142 may be a bolting tongue configured to be bolted to another component. The wire barrel 140 includes a chamber that defines an insert passage 146. The wire retention seal 110 is inserted into the insert passage 146. For example, the terminal mounting flange 112 is loaded into the insert passage 146 and secured therein to axially secure the wire retention seal 110 to the terminal 101. Optionally, the entire wire retention seal 110 is loaded into the insert passage 146. Optionally, the rear end 118 may be visible at the rear end of the terminal 101 to ensure proper positioning of the wire retention seal 110 in the terminal 101.

Once the wire retention seal 110 and the wire 102 are loaded into the wire barrel 140, a crimping tool is used to crimp the wire barrel 140 to the assembly. During the crimping operation, the wire barrel 140 is crimped around the wire retention seal 110 such that internal walls that define the crimping chamber compress into the wire retention seal 110, which therefore compresses into the jacket 106 of the wire 102 to create a seal between the terminal 101 and the jacket 106 of the wire 102. A fluid-tight seal is created by the wire retention seal 110 between the jacket 106 and the wire barrel 140. The terminal 101 is also compressed into the conductor 104 of the wire 102 to create an electrical connection between the terminal 101 and the wire 102. Accordingly, a single crimping operation may electrically and mechanically connect the terminal 101 to the wire 102 and, at the same time, provide a fluid-tight seal between the terminal 101 and the wire retention seal 110, as well as a fluid-tight seal between the wire retention seal 110 and the insulating jacket 106.

Figure 2:
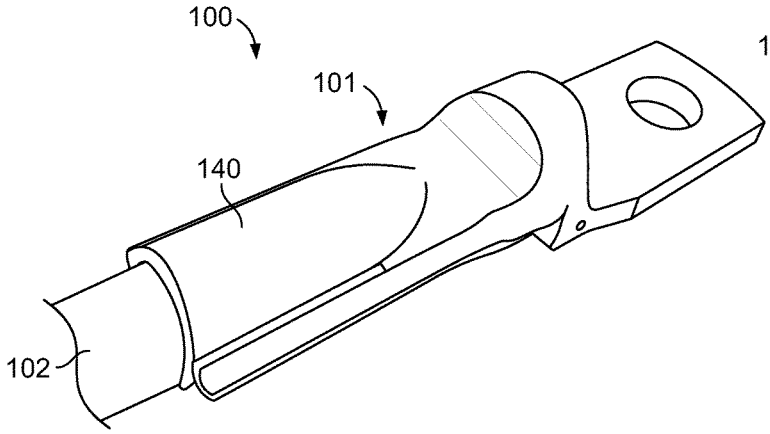
FIG. 2 is a perspective view of a terminal of the terminal assembly crimped to a wire and wire retention seal according to an embodiment.

FIG. 2 is a perspective view of the terminal 101 crimped to the wire 102 and the wire retention seal 110 according to an embodiment of the present disclosure. A crimping tool is operated to form a crimp at an area that compressively crimps the wire barrel 140 to the wire 102, which, in turn, crimps the wire retention seal 110 between the wire 102 and the terminal 101.

Figure 3:
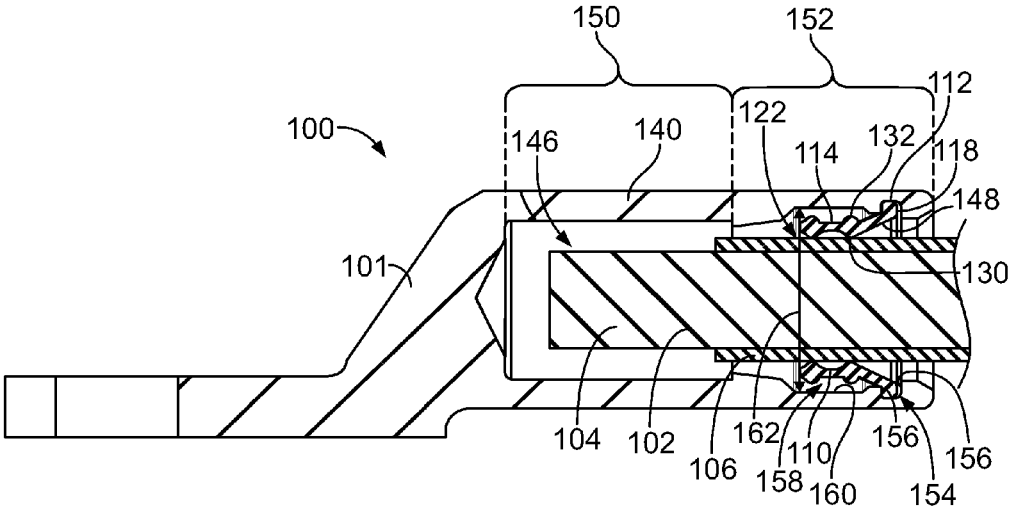
FIG. 3 is a cross-sectional view of a portion of the terminal assembly showing the wire retention seal and wire loaded in the terminal prior to crimping the terminal around the wire.
Figure 4:
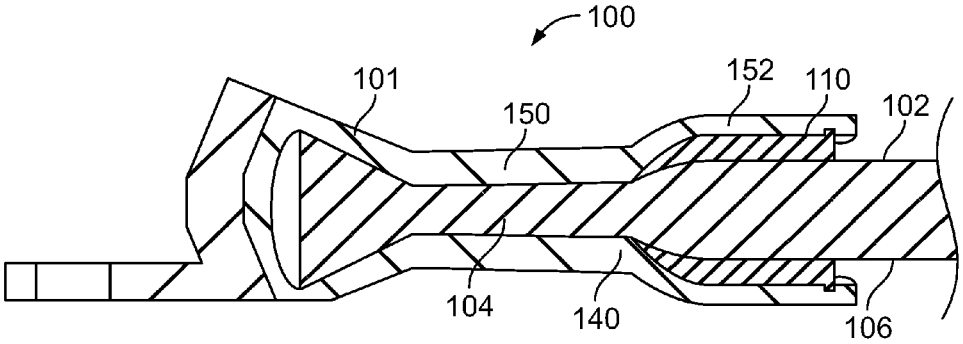
FIG. 4 is a cross-sectional view of a portion of the terminal assembly showing the terminal crimped to the wire.

FIG. 3 is a cross-sectional view of a portion of the terminal assembly 100 showing the wire retention seal 110 and wire 102 loaded in the terminal 101, prior to crimping the terminal 101 around the wire 102. FIG. 4 is a cross-sectional view of a portion of the terminal assembly 100 showing the terminal 101 crimped to the wire 102. The wire retention seal 110 includes a tapered lead-in 148 at the rear end 118 to guide the wire 102 into the wire retention seal 110. Optionally, the wire barrel 140 may additionally or alternatively include a tapered lead-in. The tapered lead-ins align the wire 102 with the opening in the wire retention seal 110 to prevent damage to the wire 102, such as to prevent bending of the strands of the wire 102 during insertion. In an exemplary embodiment, the wire barrel 140 includes a conductor barrel 150 and a jacket barrel 152 rearward of the conductor barrel 150. The conductor barrel 150 is configured to be crimped to the conductor 104 of the wire 102. The jacket barrel 152 is configured to be crimped to the jacket 106 of the wire 102. The wire retention seal 110 is received in the wire barrel 140 such that the wire retention sleeve 114 is axially aligned with the jacket barrel 152.

In an exemplary embodiment, the wire retention sleeve 114 is radially spaced apart from the jacket barrel 152 prior to the jacket barrel 152 being crimped. The wire retention sleeve 114 is able to expand when the wire 102 is loaded therein. The wire retention sleeve 114 is movable within the insert passage 146 to position the wire 102 in the wire barrel 140. The wire retention sleeve 114 is spaced apart from the wire barrel 140 to allow the wire barrel 140 to compress during crimping prior to engaging the wire retention sleeve 114. The wire retention sleeve 114 is configured to be crimped between the wire barrel 140 of the terminal 101 and the wire 102 when the wire barrel 140 is crimped around the wire 102.

The wire retention sleeve 114 receives the wire 102 by a tight fit. For example, the wire retention sleeve 114 conforms to the wire 102 as the wire 102 is loaded through the wire bore 122. The wire retention sleeve 114 is stretched and expanded outward by the wire 102 to change the shape of the wire retention sleeve 114 when coupled to the wire 102. For example, the diameter of the wire retention sleeve 114 increases when the wire 102 is loaded therein. The inner sealing rings 130 seal against the wire 102 when the wire 102 is loaded therein. For example, the inner sealing rings 130 seal against the jacket 106 by a sealing engagement. The material of the wire retention seal 110 may create friction at the interface between the inner sealing rings 130 and the jacket 106 to hold the axial position of the wire 102 in the wire retention seal 110. The wire retention seal 110 is axially retained on the end of the wire 102 prior to crimping the wire barrel 140 to the wire 102.

The terminal mounting flange 112 is held in a mounting channel 154 to hold an axial position of the wire retention seal 110 relative to the terminal 101. The mounting channel 154 may extend circumferentially around the passage 146. The terminal 101 may include rims 156 on the front and/or rear sides of the mounting channel 154 to hold the terminal mounting flange 112 in the mounting channel 154. Optionally, the rear end 118 of the wire retention seal 110 is positioned forward of the rear end of the terminal 101 such that the wire retention seal 110 remains inside the terminal 101 when crimped. For example, when the wire retention seal 110 is compressed, the wire retention seal 110 does not flatten out of the passage 146. In various embodiments, the wire retention seal 110 is not visible from the rear end of the terminal 101. In other various embodiments, the wire retention seal 110 may be flush with the rear end of the terminal 101 such that the wire retention seal 110 is visible prior to the crimping process to visually ensure that the wire retention seal 110 did not move during loading or transport and is properly positioned prior to starting the crimping process.

The wire retention sleeve 114 extends forward of the terminal mounting flange 112. The wire retention sleeve 114 is loosely held in the wire barrel 140 by the terminal mounting flange 112 such that the wire retention sleeve 114 is able to float relative to the wire barrel 140. The wire retention sleeve 114 is axially aligned with the jacket barrel 152 when assembled and is radially spaced apart from the jacket barrel 152 prior to the jacket barrel 152 being crimped. For example, a relief space 158 is defined concentrically outside of the wire retention sleeve 114 between the wire barrel 140 and the wire retention sleeve 114. The relief space 158 provides a space for the wire retention sleeve 114 to expand when the wire 102 is loaded through the wire bore 122. The relief space 158 is eliminated when the wire barrel 140 is crimped to the wire retention sleeve 114 and the wire 102. For example, the wire barrel 140 is compressed to close the relief space 158. The jacket barrel 152 has an interior surface 160 facing the wire retention sleeve 114. The jacket barrel 152 has a jacket barrel diameter 162 at the interior surface 160 before the jacket barrel 152 is crimped. The jacket barrel diameter 162 is reduced when the jacket barrel 152 is crimped. However, because the outer diameter 136 of the wire retention sleeve 114 is smaller than the jacket barrel diameter 162, the jacket barrel 152 is at least partially crimped prior to engaging the wire retention sleeve 114. As such, the wire retention sleeve 114 is not compressed through the entire crimp, reducing the risk of the wire retention sleeve 114 being moved during the crimping process, being damaged during the crimping process or being unevenly crimped (for example, bunched or folded) during the crimping process. The outer sealing rings 132 engage the jacket barrel 152 when crimped to seal against the terminal 101.

Figure 5:
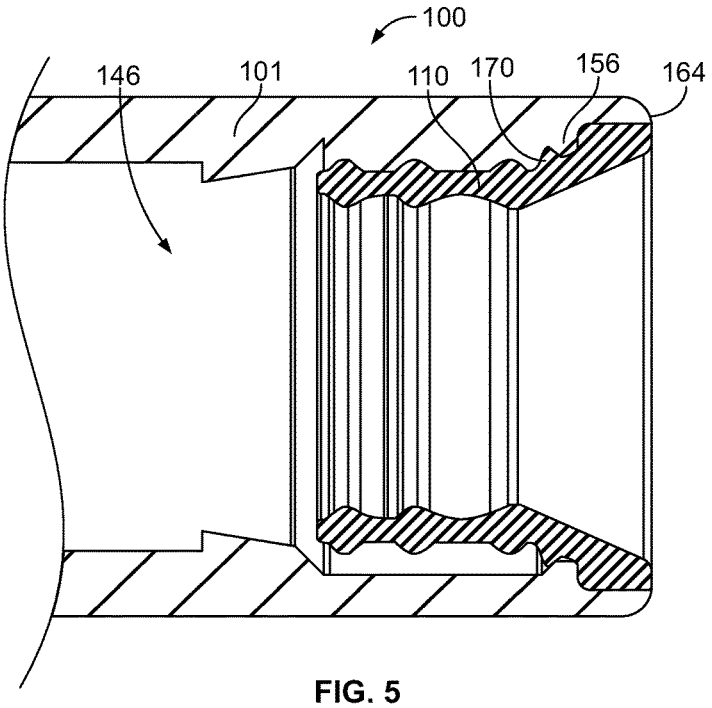
FIG. 5 is a cross-sectional view of a portion of the terminal assembly showing the wire retention seal and wire loaded in the terminal prior to crimping the terminal around the wire in accordance with an exemplary embodiment.

FIG. 5 is a cross-sectional view of a portion of the terminal assembly 100 showing the wire retention seal 110 and wire 102 loaded in the terminal 101 prior to crimping the terminal 101 around the wire 102 in accordance with an exemplary embodiment. The wire retention seal 110 is shown flush with a rear end 164 of the terminal 101. The wire retention seal 110 is visible prior to crimping to ensure that the wire retention seal 110 is properly seated at the correct location. The wire retention seal 110 includes a locating gland 170 engaging the rim 156 to prevent pull-out of the wire retention seal 110 from the passage 146.

Figure 6:
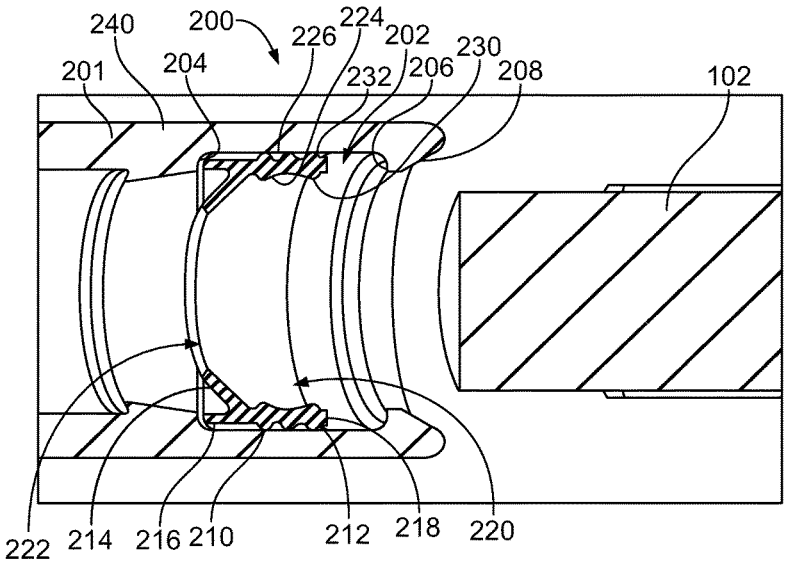
FIG. 6 is a cross-sectional view of a portion of a terminal assembly showing a wire retention seal in accordance with an exemplary embodiment.

FIG. 6 is a cross-sectional view of a portion of a terminal assembly 200 showing a wire retention seal 210 in accordance with an exemplary embodiment. The wire retention seal 210 holds the wire 102 in a terminal 201, prior to crimping the terminal 201 around the wire 102. The terminal 201 is similar to the terminal 101 illustrated above; however, the terminal 201 includes a seal cavity 202 that receives the wire retention seal 210. The seal cavity 202 is defined between a front rim 204 and a rear rim 206. Optionally, the wire retention seal 210 may be axially movable in the seal cavity 202 between the front and rear rims 204, 206. The front and rear rims 204, 206 contain the wire retention seal 210 in the terminal 201. The terminal 201 includes a tapered lead-in 208 at the rear to guide the wire 102 into the terminal 201.

The wire retention seal 210 is formed from a sealing material, such as rubber, silicone rubber, or the like. The wire retention seal 210 includes a terminal mounting flange 212 used to secure the wire retention seal 210 to the terminal 201 during assembly. For example, the terminal mounting flange 212 may be loaded into the terminal 201 prior to loading the wire 102 into the terminal 201. The terminal mounting flange 212 holds the axial position of the wire retention seal 210 in the terminal 201 for loading the wire 102 into the wire retention seal 210 and the terminal 201 during assembly. The terminal mounting flange 212 may extend an entire length of the wire retention seal 210.

The wire retention seal 210 may be sealed against the wire 102 and sealed against the terminal 201. The wire retention seal 210 may be sealed against the terminal 201 prior to the terminal 201 being crimped around the wire 102. The wire retention seal 210 is configured to be positioned between the wire 102 and the terminal 201 and is crimped against the wire 102 when the terminal 201 is crimped to the wire 102. The wire retention seal 210 is configured to be sealed to the insulating jacket 106.

The wire retention seal 210 includes a wire retention sleeve 214 extending from the terminal mounting flange 212. The wire retention sleeve 214 receives an end of the wire 102 and is used to retain the wire 102 in the terminal 201 prior to crimping and/or to retain the terminal 201 on the wire 102 prior to crimping. In an exemplary embodiment, the wire retention sleeve 214 is angled inward from the terminal mounting flange 212. The wire retention sleeve 214 may be spread open when the wire 102 is loaded therein to engage and hold the wire 102 therein, such as by an interference or friction fit.

The wire retention seal 210 extends between a front end 216 and a rear end 218. The wire retention sleeve 214 may be provided at or near the front end 216. The front end 216 is configured to be loaded into the terminal 201. The wire 102 is rear loaded into the wire retention seal 210 through the rear end 218. In an exemplary embodiment, the wire retention seal 210 is flush with the interior surface of a wire barrel 240 of the terminal 210. The wire seal 210 is compressed with the wire barrel 240 when the wire barrel 240 is crimped. The terminal mounting flange 212 is ring shaped and includes an opening 220 that receives the wire 102 during assembly. The wire retention sleeve 214 defines a wire bore 222 that receives the end of the wire 102 as the wire 102 is loaded through the opening 220. The wire bore 222 defines an internal passage through the wire retention seal 210.

The wire retention seal 210 has an inner surface 224 configured to face the wire 102. The wire retention seal 210 has an outer surface 226 configured to face the terminal 201. The inner surface 224 has inner sealing rings 230 configured to seal against the wire 102. The outer surface 226 has outer sealing rings 232 configured to seal against the terminal 201.

Embodiments of the present disclosure may provide simple and efficient systems and methods for securely connecting a wire to a terminal using the wire retention seal. The terminal may be held on the wire and transported to a crimping machine or manipulated within the crimping machine without changing the relative positions between the terminal and the wire leading to improved terminal crimps.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A terminal assembly comprising:

a terminal having a wire barrel configured to be crimped to a wire and a mating segment configured to be mated to a mating component; and a wire retention seal received in the wire barrel, the wire retention seal having a terminal mounting flange engaging the wire barrel to axially secure the wire retention seal to the terminal, the wire retention seal having a wire retention sleeve defining a wire bore configured to receive an end of the wire, the wire retention sleeve being configured to interfere with the wire to axially retain the wire retention seal on the end of the wire prior to crimping the wire barrel to the wire.

2. The terminal assembly of claim 1, wherein the wire retention sleeve is configured to be crimped between the wire barrel of the terminal and the wire when the wire barrel is crimped around the wire.

3. The terminal assembly of claim 1, wherein the wire retention sleeve is loosely held in the wire barrel by the terminal mounting flange such that the wire retention sleeve is able to float relative to the wire barrel.

4. The terminal assembly of claim 1, wherein the wire retention sleeve includes inner ring seals sealable to the wire and outer ring seals sealable to the wire barrel.

5. The terminal assembly of claim 1, wherein a relief space is defined concentrically between the wire barrel and the wire retention sleeve, the relief space being eliminated when the wire barrel is crimped to the wire retention sleeve and the wire.

6. The terminal assembly of claim 1, wherein the wire barrel includes a mounting channel receiving the terminal mounting flange to hold an axial position of the wire retention seal relative to the terminal.

7. The terminal assembly of claim 1, wherein the wire barrel includes a conductor barrel and a jacket barrel rearward of the conductor barrel, the conductor barrel being configured to be crimped to a conductor of the wire, the jacket barrel being configured to be crimped to a jacket of the wire, the wire retention sleeve being axially aligned with the jacket barrel and being radially spaced apart from the jacket barrel prior to the jacket barrel being crimped.

8. The terminal assembly of claim 7, wherein the jacket barrel has an interior surface having a first diameter before the wire barrel is crimped, the wire retention sleeve having a second diameter smaller than the first diameter.

9. The terminal assembly of claim 1, further comprising the wire, the wire retention sleeve retaining the terminal on the wire prior to the wire barrel being crimped to the wire.

10. The terminal assembly of claim 1, wherein the wire retention sleeve extends forward of the terminal mounting flange.

11. The terminal assembly of claim 1, wherein the wire retention sleeve includes a front end and a rear end, the wire retention sleeve provided at the front end.

12. The terminal assembly of claim 11, wherein the rear end is exposed at a rear end of the terminal.

13. The terminal assembly of claim 1, wherein the wire retention sleeve includes a tapered lead-in to the wire bore.

14. A terminal assembly comprising:

a terminal having a wire barrel configured to be crimped to a wire and a mating segment configured to be mated to a mating component; and a wire retention seal received in the wire barrel, the wire retention seal having a terminal mounting flange engaging the wire barrel to axially secure the wire retention seal to the terminal, the wire retention seal having a wire retention sleeve defining a wire bore configured to receive an end of the wire, the wire retention sleeve having an inner surface defining the wire bore and facing the wire, the wire retention sleeve having an outer surface facing the wire barrel, the inner surface having inner sealing rings configured to seal against the wire, the outer surface having outer sealing rings configured to seal against the wire barrel, the wire retention sleeve being configured to interfere with the wire to axially retain the wire retention seal on the end of the wire prior to crimping the wire barrel to the wire.

15. The terminal assembly of claim 14, wherein the inner sealing rings narrow a diameter of the wire bore to seal against the wire and wherein the outer sealing rings increase a diameter of the wire retention seal to seal against the wire barrel.

16. The terminal assembly of claim 14, wherein the wire retention sleeve is configured to be crimped between the wire barrel of the terminal and the wire when the wire barrel is crimped around the wire.

17. The terminal assembly of claim 14, wherein the wire retention sleeve is loosely held in the wire barrel by the terminal mounting flange such that the wire retention sleeve is able to float relative to the wire bore.

18. The terminal assembly of claim 14, wherein a relief space is defined concentrically between the wire barrel and the wire retention sleeve, the relief space being eliminated when the wire barrel is crimped to the wire retention sleeve and the wire.

19. The terminal assembly of claim 14, wherein the wire retention sleeve includes a tapered lead-in to the wire bore.

20. A terminal assembly comprising:

a terminal having a wire barrel configured to be crimped to a wire and a mating segment configured to be mated to a mating component, the wire barrel having a conductor barrel and a jacket barrel rearward of the conductor barrel, the conductor barrel being configured to be crimped to a conductor of the wire, the jacket barrel being configured to be crimped to a jacket of the wire; and a wire retention seal received in the jacket barrel, the wire retention seal having a terminal mounting flange engaging the wire barrel to axially secure the wire retention seal to the terminal, the wire retention seal having a wire retention sleeve defining a wire bore configured to receive an end of the wire, the wire retention seal being axially aligned with the jacket barrel and being radially spaced apart from the wire barrel prior to the wire barrel being crimped defining a relief space between the wire retention seal and the jacket barrel, the wire retention sleeve being configured to receive the end of the wire, the relief space providing a space for the wire retention sleeve to expand when the wire is loaded through the wire bore, the wire retention sleeve being configured to axially retain the wire retention seal on the end of the wire prior to crimping the wire barrel to the wire.

* * * * *